United States Patent [19]

Zarogatsky et al.

[11] Patent Number: 4,592,517

[45] Date of Patent: Jun. 3, 1986

[54] INERTIA CONE CRUSHER

[76] Inventors: Leonid P. Zarogatsky, Uglovoi pereulok, 5, kv. 21; Nikolai A. Ivanov, Novo-Izmailovsky prospekt, 19, kv. 26; Mikhail F. Korolkov, Zheleznovodskaya ulitsa, 62, kv. 99; Villi R. Laubgan, Krasnoselskoe shosse, 46, korpus 3, kv. 66; Andrei N. Safronov, ulitsa Korablestroitelei, 19, korpus 1, kv. 728; Vladimir Y. Turkin, Novo-Izmailovsky prospekt, 49, kv. 10; Boris G. Ivanov, Basseinaya ulitsa, 5, kv. 8, all of Leningrad, U.S.S.R.

[21] Appl. No.: 725,650

[22] Filed: Apr. 22, 1985

[51] Int. Cl.[4] ..... B02L 2/04

[52] U.S. Cl. ..... 241/207; 241/210

[58] Field of Search ..... 241/207–216, 241/286, 290

[56] References Cited

U.S. PATENT DOCUMENTS 4,452,401 6/1984 Zarogatsky ..... 241/207

FOREIGN PATENT DOCUMENTS 481305 8/1978 U.S.S.R. .

1039555 4/1979 U.S.S.R. .

*Primary Examiner*—Howard N. Goldberg

*Assistant Examiner*—Timothy V. Eley

*Attorney, Agent, or Firm*—Lilling & Greenspan

[57] ABSTRACT

An inertia cone crusher comprises a housing having an outer cone and a spherical support of an inner cone which is installed concentrically with the outer cone. A cylindrical bearing bush carrying an unbalanced mass member is installed on the inner cone shaft and is connected to a power motor by means of a flexible link. The bush is connected to the housing by means of a spherical support, and for that purpose, an annular bore with a spherical surface is made in the housing, the bush has an annular outer projection on the end thereof facing the inner cone, and an annular "floating" end thrust bearing is provided between the annular projection and the spherical surface of the bore, the end thrust bearing engaging with its spherical surface the spherical surface of the bore.

2 Claims, 1 Drawing Figure

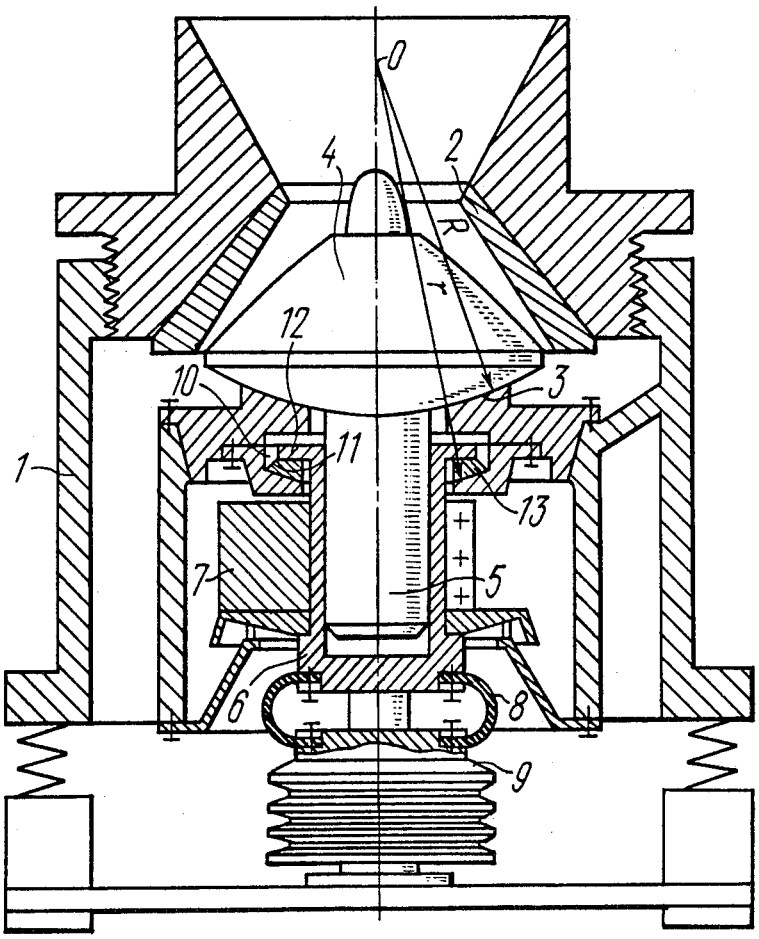
0
4
2
R
r
12
10
3
11
1
13
7
5
6
8
9

INERTIA CONE CRUSHER

FIELD OF THE ART

The invention relates to apparatus for crushing and comminuting solids, and more particularly, it deals with inertia cone crushers and may be most widely used at ore preparation departments of ore concentration plants in the non-ferrous and ferrous metallurgy.

BACKGROUND OF THE INVENTION

The main assembly of inertia crushers making their construction and operation rather complicated is the assembly of unbalanced mass drive of the inner cone. In this light, simplifying the abovementioned assembly is the main trend in the improvement of inertia crushers.

Known in the art is an inertia cone crusher comprising a housing having an outer cone and an inner cone having a spherical support and a shaft on which is installed a cylindrical bearing bush of an unbalanced mass member, the bush having a spherical end thrust bearing (cf. USSR Inventor's Certificate No. 481305, publ. 1975).

The spherical end thrust bearing of the bush is provided on the end of an intermediate shaft journalled in the housing by means of bearings and having a crank drive for transmitting rotation to the bush to which the unbalanced mass member is secured.

This construction is rather complicated owing to the provision of the intermediate shaft and the crank drive. In addition, the assembly of the unbalanced mass member system is difficult because it is necessary to couple the unbalanced mass member to the intermediate shaft in the interior of a crank case which is inaccessible for inspection.

Also known in the art is an inertia cone crusher compising a housing having an outer cone secured thereto, and inner cone mounted concentrically with the outer cone on a spherical support in the housing for rotation about its axis and gyratory motion relative to the axis of the outer cone, the inner cone having a shaft. A cylindrical bearing bush is installed on the inner cone shaft, the bush supporting an unbalanced mass member and being connected by means of a flexible link to a power drive. The inner cone shaft has at the free end thereof a bore in which is secured a spherical support of the bush carrying a spherical end thrust bearing engaging with its annular flat surface a pivot journal which is rigidly connected to the bottom wall of the bush by means of a central rod. For locking the position of the unbalanced mass system there are provided at least three hydraulic jacks in the bottom wall of the housing of the prior art crusher (cf. USSR Inventor's Certificate No. 1039555, publ. 1983).

In using the prior art cone crusher, the inner cone is dismantled (e.g. for replacing its wear plates) by uncoupling the shaft from the bush. For that purpose, the central rod is relieved from the mass of the bush and unblanced mass member by lifting the assembly by means of the jacks relative to the inner cone shaft. This facility, at the same time, provides for positioning the bush almost vertically. Then the rod shank clamp is released, the outer cone unscrewed, and the inner cone removed. The assembly is carried out in the reversed order. In doing this, it is necessary to make certain that the central rod is in the vertical position so as to be received in the bush bottom hole.

High labour consumption of the abovedescribed operations combines with the need to manipulate the clamp and jacks in a very restricted space since all these assemblies are accommodated under the crusher.

The need to have the clamp and jacks makes the crusher construction complicated.

SUMMARY OF THE INVENTION

It is the main object of the invention to simplify the assembly of support and drive of the bush with unbalanced mass member in an inertia cone crusher.

Another object of the invention is to reduce labour consumption, effort and time of manual labour used for assembly and disassembly of the inner cone in an inertia cone crusher.

This is accomplished by that in an inertia cone crusher comprising a housing, an outer cone secured in the housing, an inner cone mounted concentrically with the outer cone on a spherical support for rotation about its axis and gyratory motion about the axis of the outer cone, an inner cone shaft, a cylindrical bearing bush carrying an unbalanced mass member, installed on the inner cone shaft, connected by means of a flexible member to a power motor and having a spherical end thrust bearing cooperating with the spherical support of the bush, according to the invention, the spherical support of the bush is made in the form of an annular bore in the housing concentric with the bush, an annular outer projection is provided on the end of the bush on the side facing the inner cone, the projection being received in the bore, and an annular "floating" end thrust bearing is provided between the projection and the spherical surface of the bore, the annular end thrust bearing engaging the spherical surface of the annular bore.

In order to avoid harmful displacements of the bush relative to the shaft and end thrust bearing, the center of sphere of the end thrust bearing of the cylindrical bush preferably coincides with the center of sphere of the inner cone support. In the inertia cone crusher according to the invention, the assembly of support and drive of the cylindrical bush with the unbalanced mass member is of a simplified structure: it does not have any clamp for a bush suspension rod, and the inner cone shaft is solid without cavity. In addition, this construction of the crusher does not require any jacks for locking the position of the unbalanced mass system.

In case it is necessary to dismantle the inner cone, e.g. for replacing its lining, it is only the outer cone that should be unscrewed without having to carry out any other auxiliary operations otherwise necessary in prior art crushers. In addition, in the crusher according to the invention, the operation of installation or dismantling of the spherical support of the inner cone is automatically completed together with the unbalanced mass vibrator assembly, i.e. in one and the same stage.

BRIEF DESCRIPTION OF THE DRAWING

The invention will now be described with reference to specific embodiments illustrated in the accompanying drawing showing an inertia cone crusher according to the invention in a sectional view.

DETAILED DESCRIPTION OF THE INVENTION

An inertia cone crusher shown in the drawing comprises a housing 1 in which there is secured an outer cone 2 by means of a threaded joint. A spherical support 3 of the housing 1 supports an inner cone 4 mounted concentrically with the outer cone and having a shaft 5 extending along the axis of symmetry of the cone 4. The cone 4 is installed on the support 3 for rotation about its axis of symmetry and for gyratory motion about the axis of symmetry of the outer cone 2. A cylindrical bearing bush 6 carrying an unbalanced mass member 7 is installed on the shaft 5 of the inner cone 4. The bush 6 is connected by means of a flexible member in the form of a plate chutch 8 to a drive pulley 9 of a power motor (not shown in the drawing). An annular bore 10 having a spherical surface 11, which is the spherical support of the bush 6, is made in the housing 1 concentrically with the bush 6. The bush has an outer annular projection 12 on the end thereof on the side facing the inner cone 4, the projection being received in the bore 10. An annular "floating" end thrust bearing 13 is provided between the projection 12 and spherical surface 11 of the bore 10 to engage with its flat surface the projection 12 and, with its spherical surface, the spherical surface 11 of the bore 10. The center "O" of the spherical surface 11 and, respectively, of the spherical surface of the end thrust bearing 13 coincides with the center "O" of sphere of the spherical support 3 of the inner cone 4.

The inertia cone crusher functions in the following manner.

Rotary motion of the pulley 9 is transmitted through the plate clutch 8 to the cylindrical bush 6 and to the unbalanced mass member 7 secured thereto. The bush has its projection 12 rotating on the end thrust bearing 13 which oscillates on the spherical surface 11. Therefore, the mass and gyratory component of the centrifugal force of the unbalanced mass member 7 are taken-up by the body of the spherical support 3 and inner cone 4.

The coincidence of the centers "O"of sphere of the support 3 and sphere of the surface 11 ensures the elimination of a harmful vertical displacement of the bush 6 relative to the shaft 5 and harmful radial displacements of the bush 6 relative to the end thrust bearing 13. Under the action of centrifugal force generated by the revolving unbalanced mass member 7, the inner cone 4 performs gyratory motion relative to the axis of the outer cone 2 so that the material between the cones 2 and 4 is crushed.

The construction of the crusher according to the invention enables easy assembly and disassembly of the inner cone 4 without the need to align the bush 6 or lift it, and the operation of uncoupling the bush 6 from the cone 4 are also eliminated. To provide for an access to the inner cone 4, it is only the outer cone 2 secured to the housing 1 by means of a threaded joint that should be removed from the housing 1.

What we claim is:

1. An inertia cone crusher comprising:

a housing;

an outer cone secured in said housing;

an inner cone mounted concentrically with said outer cone and in space relation therewith for rotation about its axis of symmetry and for gyratory motion about the axis of symmetry of said outer cone;

a spherical support of said inner cone secured in said housing;

a shaft of said inner cone extending along the axis of symmetry thereof;

a cylindrical bearing bush mounted on said shaft;

an unbalanced mass member rigidly secured to said bearing bush;

an annular outer projection on the end of said bush facing toward said inner cone;

a spherical support of said bush comprising an annular bore of said housing concentric with said bush and having a spherical surface;

said annular projection being received in said annular bore;

a spherical end thrust bearing of said bush comprising a "floating" ring having a spherical surface and installed in said annular bore between said annular projection and said spherical surface of the annular bore, said floating ring having its spherical surface engaging the spherical surface of the bore;

a power motor;

a flexible link connecting said power motor to said bearing bush.

2. An inertia cone crusher according to claim 1, wherein the center of sphere of said spherical support of said inner cone coincides with the center of sphere of said spherical surface of the annular bore.

* * * * *